US008017890B2

(12) United States Patent
Paradiso et al.

(10) Patent No.: US 8,017,890 B2
(45) Date of Patent: Sep. 13, 2011

(54) CONTINUOUS CAPACITIVE SLIDER CONTROLLER FOR A SMOOTH SURFACED COOKTOP

(75) Inventors: Joseph A. Paradiso, Medford, MA (US); Lance L. Bourque, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/894,611

(22) Filed: Jul. 20, 2004

(65) Prior Publication Data

US 2006/0016800 A1 Jan. 26, 2006

(51) Int. Cl.
*H05B 3/68* (2006.01)

(52) U.S. Cl. ..... 219/457.1; 219/443.1; 219/452.12; 219/445.1; 219/446.1

(58) Field of Classification Search ..... 219/385, 219/443.1, 445.1, 446.1, 447.1, 450.1, 451.1, 219/452.11, 457.1, 460.1, 468.2, 452.12
See application file for complete search history.

(56) References Cited

U.S. PATENT DOCUMENTS

| | | | | | |
|---|---|---|---|---|---|
| 4,121,204 | A * | 10/1978 | Welch et al. | 345/174 |
| 4,999,462 | A * | 3/1991 | Purcell | 178/18.03 |
| 5,008,497 | A * | 4/1991 | Asher | 178/18.05 |
| 5,136,277 | A * | 8/1992 | Civanelli et al. | 340/568.1 |
| 5,155,338 | A * | 10/1992 | Hoffmann | 219/445.1 |
| 5,572,205 | A * | 11/1996 | Caldwell et al. | 341/33 |
| 5,717,189 | A * | 2/1998 | Goetz et al. | 219/483 |
| 6,297,811 | B1 * | 10/2001 | Kent et al. | 345/173 |
| 6,452,514 | B1 * | 9/2002 | Philipp | 341/33 |
| 6,614,006 | B2 * | 9/2003 | Pastore et al. | 219/447.1 |
| 6,879,930 | B2 * | 4/2005 | Sinclair et al. | 702/150 |
| 2003/0028346 | A1 * | 2/2003 | Sinclair et al. | 702/150 |
| 2003/0042044 | A1 * | 3/2003 | Kirk | 174/255 |
| 2003/0067451 | A1 * | 4/2003 | Tagg et al. | 345/174 |
| 2004/0104826 | A1 * | 6/2004 | Philipp | 341/34 |
| 2004/0238524 | A1 * | 12/2004 | Lerner | 219/445.1 |

FOREIGN PATENT DOCUMENTS

| | | | |
|---|---|---|---|
| GB | 2286247 | A * | 8/1995 |
| JP | 01196423 | A * | 8/1989 |

* cited by examiner

*Primary Examiner* — Stephen J Ralis
(74) *Attorney, Agent, or Firm* — Stephen R. Otis

(57) ABSTRACT

A touch responsive capacitive control for a smooth surfaced ceramic cooktop provides a continuously variable control voltage which indicates the last touched position on an elongated control surface. An alternating current potential is applied between a transmitter plate and a pair of receiver plates all of which are positioned below the surface of the cooktop. The relative area of overlap between the touching finger and the two receiver plates varies along the length of the control surface, and the resulting change in the relative currents flowing to the two receiver plates is sensed to provide a position indication used to control the cooktop.

20 Claims, 4 Drawing Sheets

CONTINUOUS CAPACITIVE SLIDER CONTROLLER FOR A SMOOTH SURFACED COOKTOP

FIELD OF THE INVENTION

This invention relates to capacitive sensors and more particularly, although in its broader aspects not exclusively, to a capacitive continuous position sensor used to control a ceramic cooktop heating element.

BACKGROUND OF THE INVENTION

Cooktops having flat glass or ceramic cooking surfaces on which pots, pans or other cooking utensils are placed to be heated are well known in the art. A flat glass ceramic surface has many advantages. It provides a unitary surface which is aesthetically pleasing to the eye, greatly enhances the ease with which the cooktop may be cleaned, and does not require precise positioning of the pot or pan to be heated. Ceramic cooktops are described, for example, in U.S. Pat. No. 6,410,892 issued to Peschl et al. on Jun. 25, 2002 entitled "Cooktop having a flat glass ceramic cooking surface" and in U.S. Pat. No. 6,515,263 issued to Mitra et al. on Feb. 4, 2003 entitled "Cooking stove having a smooth-top glass ceramic cooktop, and a smooth-top glass ceramic cooktop with a glass ceramic cooktop cooking surface, method for production of stoves with smooth-top glass ceramic cooktops and smooth-top glass ceramic cooktops," the disclosures of which are hereby incorporated herein by reference.

Touch controls and electronic displays have been developed for use with appliances such as cooktops. Touch panels provide a smooth control panel surface for good appearance and easy cleaning and eliminating reliability problems caused by mechanically movable switch contacts. Electronic displays used in combination with touch panel controls can provide an immediate indication to the user in an easily understood manner that the desired control function has in fact been selected and allow the user to ascertain at a glance the state of the controls, i.e., the last control operation.

U.S. Pat. No. 5,097,113 issued to Aoyama on Mar. 17, 1992 entitled "Touch switch arrangement for a heating cooking appliance" describes a heating cooking appliance that includes a heater for the cooking, a touch control switch that produces an operation signal when being touched by the user's finger, and a microcomputer for controlling the heater so that energization of the heater is initiated whenever the operation signal generated by the switch is continuously input into the microcomputer for a predetermined period of time.

U.S. Pat. No. 4,121,204 issued to Welch et al. on Oct. 17, 1978 entitled "Bar graph type touch switch and display device" describes a control for use with a cooktop consisting of an array of light transmitting touch sensitive switches that together provide a lighted, segmented bar graph display. A control circuit responsive to the touch sensitive area of each switch is connected for driving the segments of the bar graph such that, when any one of the switches is touched, a corresponding display segment and all display segments to one side of that segment are energized and the remaining display elements are de-energized.

For electrically nonconductive control surfaces that are periodically soiled and must be conveniently and often cleaned, like glass ceramic cooktops, capacitive touch controls possess significant advantages. In conventional arrangements, these touch controls are typically discrete switches. For example, two buttons are commonly associated with each burner to adjust a continuous quantity (e.g., heat) up or down.

One must repeatedly hit increment and decrement to obtain the desired parameter value. This is counter to the way one interacts in the natural, continuous world, where one normally sets a continuous, analog value. Even in the world of cooktops, the knobs that still are ubiquitous on a standard range are continuously rotated to set the desired heat level.

SUMMARY OF THE INVENTION

The present invention brings continuous adjustability back to capacitive controls, as in glass ceramic cooktops. The present invention employs a continuously adjustable slider that can be controlled by smoothly moving a finger across the glass cooktop surface. The slider uses a set of two continuously tapered (but interdigitated) electrodes, appropriately shielded with a ground and surrounded by a transmit electrode.

The preferred embodiment of the present invention takes the form of a capacitive continuous position touch control for linearly tracking the movement of a fingertip on the surface of a glass ceramic cooktop. The control employs a shunt-mode transmit/receive capacitive sensor employing conductive transmitting and receiving plates which are secured to the underside of a ceramic cooktop. The geometry of the plates is optimized to follow the lateral movements of the fingertip over an area of approximately six inches while ignoring other positioning events such as movements of the hand perpendicular to the plane of the sensor or perpendicular to the direction of linear sensing. The sensor employs two interleaved receiving plates of linearly varying area and a differential measurement algorithm which substantially eliminates common-mode variations which would contribute to poor tracking.

These and other features and advantages of the present invention may be better understood by considering the following detailed description of a specific embodiment of the invention.

BRIEF DESCRIPTION OF THE DRAWINGS

In the detailed description which follows, frequent reference will be made to the attached drawings, in which.

DETAILED DESCRIPTION

The preferred embodiment of the present invention takes the form of a cooktop controller that uses a shunt-mode, capacitive, continuous linear position sensor to generate an analog position signal value that continuously varies in response to the movement of a user's finger over a control surface on the cooktop. A signal processing circuit including a microprocessor generates and stores a position value indicative of the position where the control surface was last touched. A linear array of light emitting diodes (LEDs) provides a visual indication to the user of the position value generated by the last touch. As the user's finger slides along the length of the control surface, the position value continuously varies as indicated by the continuous variation in the number of consecutive LEDs in the linear array that are lit at any given time. The sensed position value is also used to control the energization of a cooktop heating element. The control surface is preferably elongated, forming a line or a curve, and the user's finger is moved along the length of the control surface to produce an output control value whose magnitude indicates the position on the control surface last touched by the user.

Figure 1:
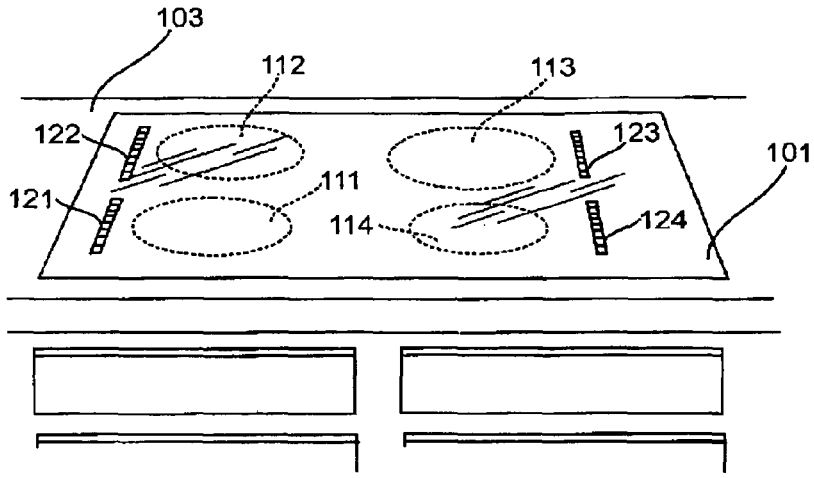
FIG. 1 is perspective view of a counter-mounted cooktop using the continuous position sensing control embodying the invention.
Figure 2:
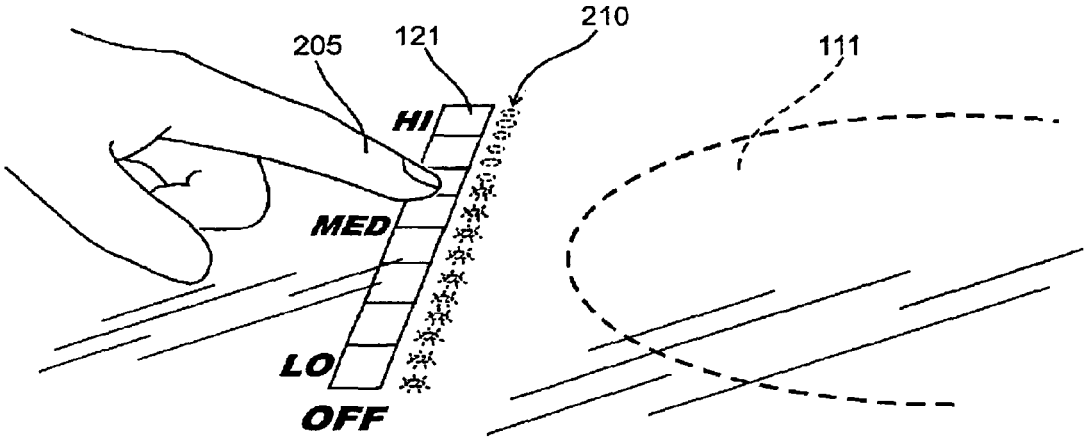
FIG. 2 is a close-up perspective view of the external appearance of a single continuous linear position sensing control as seen by a user.

An illustrative countertop cooktop is shown in FIG. 1, and an individual control is seen in FIG. 2, to illustrate how the cooktop heater is operated under fingertip control by a user. As shown in FIG. 1, a ceramic cooktop 101 mounted on a countertop 103 provides four heating elements indicated at 111-114. A indicia is printed on the cooktop to indicate the location of each control surface near each heating element as indicated at 121-124 respectively. The printed indicia visually indicates the location of a continuous position capacitive sensor which is affixed to and positioned immediately below the cooktop surface. As seen in FIG. 2, the printed indicia may include descriptive legends such as "OFF," "LO," "MED," and "HI" to indicate the effect that can be achieved by touching the control surface in different positions.

The user's finger 205 may be moved in contact with the cooktop surface along the control surface, and the last-touched position is indicated by a linear array of light emitting diodes positioned below the translucent cooktop surface as seen at 210 in FIG. 2. Preferably, all of the LEDs in the array 210 from the "LO" end of the array to the last touched position are lit, providing a variable length "light bar" that shines through the translucent cooktop surface form a position below or adjacent to the printed indicia. The LEDs in the linear array 210 which indicate the extent to which the heating element 111 is energized remain lit whenever the heating element is turned ON. By touching the control surface at its extreme "LO" end, the heating element may be turned completely OFF as manifested by extinguishing all of the LEDs in the array 210.

The preferred embodiment of the present invention preferably employs a capacitive position sensor. Capacitive sensors are described generally in the text Capacitive Sensors: Design and Applications by Larry K. Baxter, John Wiley & Sons; (Aug. 20, 1996) ISBN: 078035351X, and take a variety of forms typically including at least one conductive plate forming which is energized with an alternating current potential to create an electric field adjacent at the control surface. When a grounded conductive object (such as a human finger) is brought near the control surface, a change in the amount of current induced by the electric field can be detected to provide a touch-generated signal. In loading-mode capacitive position sensing, a transmitting plate is driven with an alternating current waveform. The plate has a minimal capacitive coupling to ground and only a small amount of current flows into it. The object to be detected must have a strong coupling to ground. When the object is brought near to the transmitter, additional current flows through the transmitter, through the object and on to ground. This increase in current is detected to provide a position indication. While loading mode sensors can be employed to provide touch position sensing need for a cooktop control, loading mode sensors have been found to provide unacceptable sensitivity to environmental noise and to variations in the loading ability of different people's fingers. Attempts to shield the sensor with grounded shielding increases the quiescent current to the point where perturbations from fingertips are very small and difficult to measure reliably.

The preferred form of capacitive position sensor described in more detail below operates in shunt-mode and employs at least two plates, a transmitter and a receiver. The transmitter is driven with an alternating current waveform causing an electric field to form around it. This field couples capacitively to the receiving plate which detects the waveform. In shunt mode, the transmitter and the receiver are fixed in space and positioned close to each other, and a large amount of the field is incident on the receiver from the transmitter in the quiescent state. The object to be detected is placed in the field and shunts some field lines away from the receiver. This causes a reduction in the strength of the received signal. This reduction is detected to provide a position indication.

Shunt-mode sensors provide significant advantages when used as a cooktop position sensor. The sensor may be shielded from noise using grounded elements as explained in more detail below, and the transmitting, receiving and grounding conductors may be placed relative to one another in ways that ensure good signal response localized over the region of interest. Finally, the fact that the transmitter and receiver plates are rigidly affixed to the cooktop surface in a fixed geometrical relationship causes the operation to be more stable.

Figure 3:
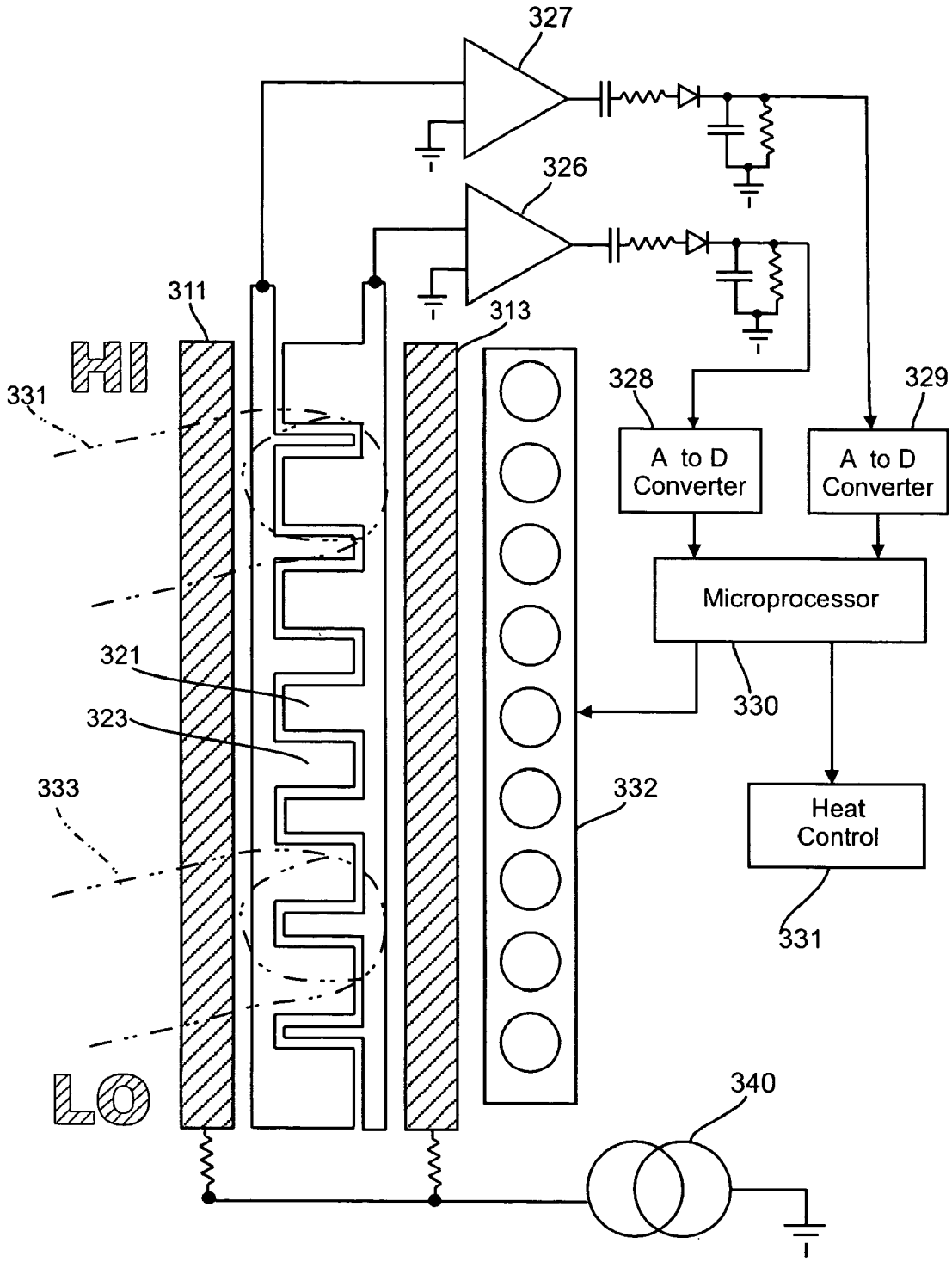
FIG. 3 is a schematic diagram illustrating the principle components of the capacitive position system embodying the invention.

FIG. 3 of the drawings illustrates a preferred embodiment of a continuous position sensor that may be used to advantage in a cooktop control. The capacitive sensor consists of a pair of transmitter plates 311 and 313 (seen cross-hatched in FIG. 3) and a pair of interleaved receiver plates 321 and 323. Each receiver plate forms a sequence of tongue plates whose width progressively increases along the length of the control surface as the spacing between adjacent tongues decreases. Thus, the width of the tongues formed by receiver plate 321 progressively increases from the "LO" to the "HI" end of the control surface while the width of the tongues formed by receiver plate 323 progressively decreases. The tongues of each receiver plate are positioned in the space between the tongues of the other receiver plate.

Other receiver plate configuration may be used in addition to the interdigitated substantially rectangular fingers shown in FIG. 3. For example, a lengthwise Backgammon-style dual pennant configuration, in which the width of one receiver progressively increases from one end to the other, while the width of the adjacent receiver progressively decreases, provides a simpler but workable form, although more sensitive to side-side motion of the fingers. Alternatively, pseudorandom sampling of vias may whose density changes with position may be employed. Also, as noted above, it may be desirable in some application that the finger movement trace out an arc instead of line to control the appliance, since the arcuate control provides a metaphor more similar to knobs. In that case, the receiver pattern may be altered to accommodate the inner/outer radius asymmetry of the curved control surface. If a curved control surface is employed, the printed indicia on the surface which shows the position of the control surface would also be curved, and the array of indicator lights used to indicated the last-touched position may also be curved to follow the curved control surface.

Each receiver plate 321 and 323 lies equally within the electric field created by the two transmitter plates 311 and 313. The receiver plates 321 and 323 are respectively connected to the input of an operational amplifier 326 and 327 respectively. The output of operational amplifier 326 is connected through a rectifier and a low pass filter circuit to supply a sensed D.C. signal to the input of an analog-to-digital converter 328, and the output of operational amplifier 327 is connected through a like circuit to supply a sensed D.C. signal to the input of a second analog-to-digital convert 329. Both A-to-D converters supply a digital signal value to a microprocessor 330 which in turn supplies a control value to the heat control 331 and energizes a portion of the LED array 332.

When the user's finger is not near the control surface, both receiver plates are subjected to the same net field intensity, with the result that the sensed digital signal values delivered by the A-to-D converters 328 and 329 are approximately equal. When the user's finger, or any other conductive object, is brought near the receiver plates, some of the transmitted field is shunted off to the finger, reducing the flow of current to both receiver plates, resulting in a decrease in both digital signal values delivered to the microprocessor 330.

When the user's finger touches the control surface over the receiver plates 321 and 323, the finger becomes capacitively coupled to both plates and to the transmitter plates 311 and 313. The user's "grounded" finger hence shunts some of the current that would normally flow from the transmitter plates through each receiver plate to the connected operational amplifier by an amount directly related to the area of overlap between the finger and each receiver plate.

When the user's finger is placed over the control surface at the "HI" end as illustrated by the finger outline 331, the finger overlaps more area of the right hand receiver plate 321 than of receiver plate 323 (since the tongues of receiver plate 321 are larger than the tongues of the receiver plate 323 at the "HI" end of the control surface). Correspondingly, when the user's finger touches the control surface at the "LO" end as illustrated at 333, where the tongues of the left-hand receiver plate 323 are larger than those of the receiver plate 321, the user's finger overlaps more area on the plate 323 than on plate 321.

Thus, when the user's finger is located at 331 near the "HI" end of control surface, the sensed value from right-hand receiver plate 321 decreases by an amount larger than the decrease in the sensed value from the left-hand plate 323. When the finger is instead at position 333 near the "LO" end of the control surface, the sensed value from the plate 323 decreases more than the value from the plate 321 decreases. In general, if $V_r$, is the sensed value from plate 321 and $V_1$ is the sensed value from plate 323, the difference value ($V_1$- $V_r$) increases monotonically as the user's finger is moved from the "LO" to the "HI" end of the control surface.

It is desirable in some applications for the sensor to "remember" or hold the position where it was last touched after the finger is removed. In order to accomplish this, the microprocessor may form the sum of the signals from the two receivers since the summed signal drops by substantially the same amount regardless of where the control surface is touched. This drop in the summed signal amplitude may be used as a triggering event: when the sum drops below a preset threshold, (e.g., 95% of the quiescent sum), tracking begins. When the finger leaves the region of the sensor the sum climbs above threshold, and a microprocessor holds the last calculated position.

Note also that it is desirable to distinguish the presence of a human finger from the presence of a large object (such as a cooking pan) which may be placed over the control surface. While the presence of a human finger or other small "footprint" object decreases the sum of the signals by an amount less than a second threshold, (e.g. to a level not less than 70% of the quiescent sum), a large grounded conductive element such as a hand-held pan will produce a substantially larger decrease. When that large decrease is detected, the stored position value may be returned to the level which existed before tracking began, effectively ignoring the effect of the large grounded object. If an ungrounded pan is placed over the control, the a capacitive pathway is established between the transmitters and both receivers, so that instead of decreasing, the sum signal increases substantially above its quiescent level. This condition may also be detected, returning the stored position value to the level which existed before tracking began, effectively ignoring the large ungrounded object.

To provide an approximately linear relationship between the sensed position and the actual finger position, the area of the flux intercepted during finger tracking may be determined by appropriately sizing the area of the interleaved tongues on the receiver plates. The receiver and transmitter plates may be implemented as printed circuit traces. The width of the largest tongues should be small compared to the width of a finger (note that, for purposes of illustration, oversize tongues are shown in FIG. 3). The smallest 'tongues' at each end of the receiver plates are preferably about 0.008 inch wide, and the largest are 0.15 inch wide. The two plates are separated by a space of 0.008 inch. The overall length of the sensing area is 6 inches, and the width of the sensing area is 0.5 inch.

The microprocessor may be calibrated to provide an output value which is linearly related to the actual touching position by storing a two dimensional lookup table indexed by the input values from the two receiver plates. The functional relationship between the lookup value and the two input variable values from the receiver plates can take the form of (1) a touch position value; (2) an "untouched" value when the sum of the two input values is greater than a first threshold (e.g. 95% if the quiescent value) which also handles the situation when a large ungrounded object "shorts" the transmitter to the receivers; and (3) a "large grounded object detected" value which indicates that the sum of the two input variables has fallen a second threshold (e.g. 70% of the quiescent value) indicating that a grounded object substantially larger than a human finger (such as a hand-held pan) has been brought near the control surface. Note that the two-dimensional lookup table can store values which provide a substantially linear relationship between the actual touch position and the output touch position result value, even though the relationship between difference between the signal levels at the receiver plates is not necessarily linearly related to the touch position. Alternatively, the desired linear relationship may be obtained by sizing and shaping the relative tongue areas.

Figure 4:
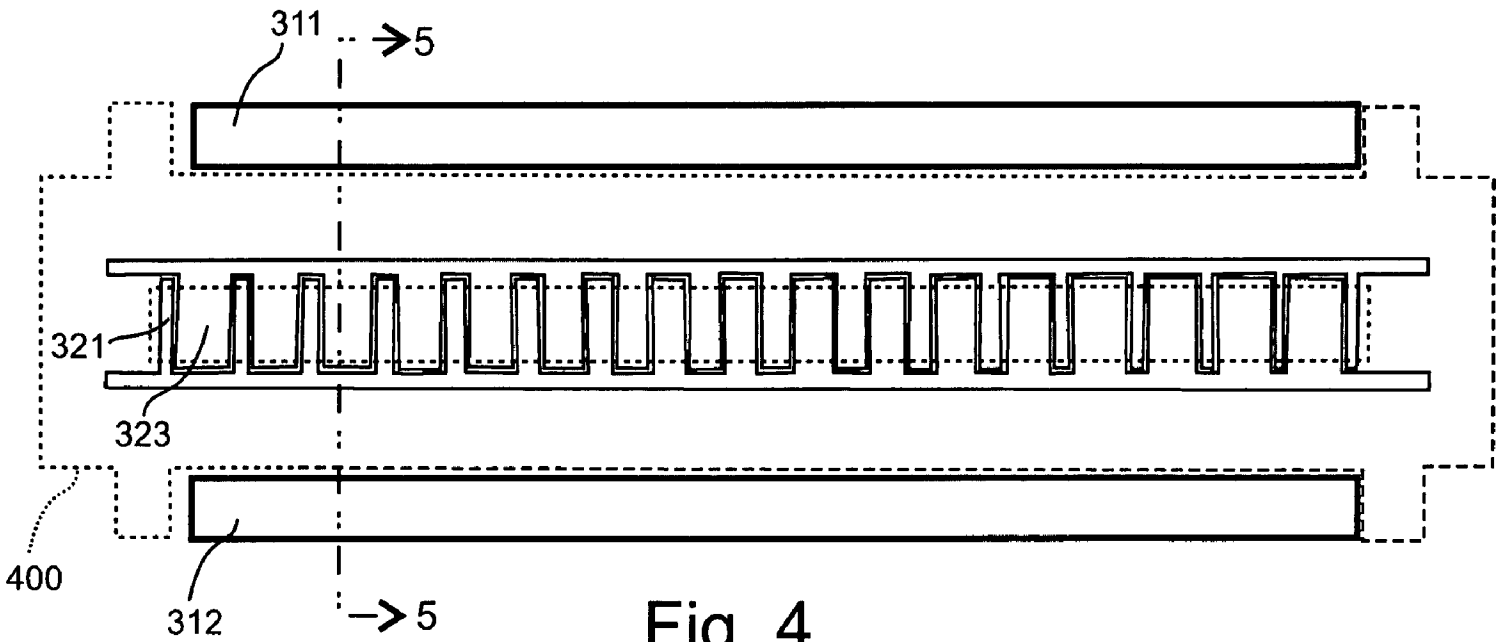
FIG. 4 is a detailed plan view of the transmitter, receiver and shielding plates used in the continuous capacitive position sensor.
Figure 5:
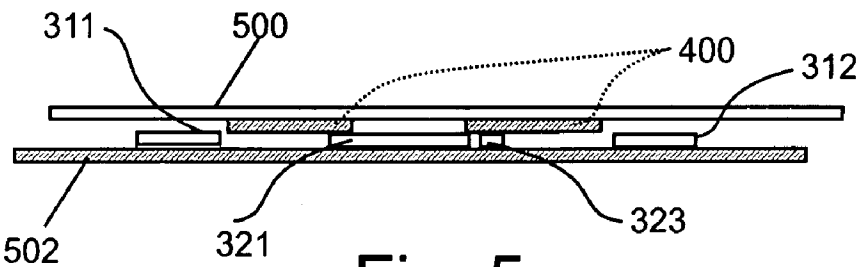
FIG. 5 is a cross-sectional view of the sensor taken along the line 5—5 of FIG. 4.

On each receiver there is an outer trace have a width of 0.008 inch which connects its 'tongues' together. These connecting traces are a source of asymmetry in the design and as such are preferably shielded. The complete sensor is shown in FIG. 4 include transmitters, receivers and shielding. The same reference numerals used in FIG. 3 are repeated in FIG. 4 to refer to comparable components of the sensor. The sensor is positioned beneath the cooktop surface provided by a ceramic plate seen at 500 in the cross-sectional view of FIG. 5 taken along the line 5—5 seen in FIG. 4. An elongated control surface extends between the two transmitter plates 311 and 312 which are capacitively coupled to the two interleaved receiver plates 321 and 323. The area of the tongues on the receiver plate 321 gradually increase from left to right as seen in FIG. 4 while the area of the tongues defined by the plate 323 gradually decrease from left to right. A grounded shield shown within the dotted lines in FIG. 4 covers the region between each transmitter plate and the receiver plates and overlaps the traces that interconnect the receiver plate tongues to prevent the asymmetry of these traces from affecting the positional linearity of the sensor. As seen in cross-section in FIG. 5, the backside of the sensor is covered by a ground plane 502.

The transmitter plates 311 and 313 transmitters and the shielding 400 may be applied to the ground plane 502 with copper tape in the same plane as the receivers but overlapping and insulated from the traces connecting the receiver tongues. In this way, the shielding at 400 exposes only the linearly-varying section of the receivers. The transmitters 311 and 312 are 0.25 inch wide and run the length of the sensing region. They are isolated from the receivers by 0.025 inch of grounded shielding 400. The transmitter plates are driven by a 50 KHz, 3.0 volt (peak to peak) sinusoid indicated by the source 340 in FIG. 4. The square wave output at a free I/O pin on the microprocessor 330, suitably filtered to prevent high frequency harmonic from causing RF interference, may be used to energize the transmitters.

Normal operation of the sensor in the application of finger tracking on glass requires this entire unit to be underneath and pressed firmly against the glass 500. A stable mechanical mount here improves the stability of the output. The high dielectric constant of the glass plate 500 reshapes the field lines in such a way as to increase the coupling of the transmitter and receiver and to increase sensitivity to perturbation by the user's finger.

Figure 6:
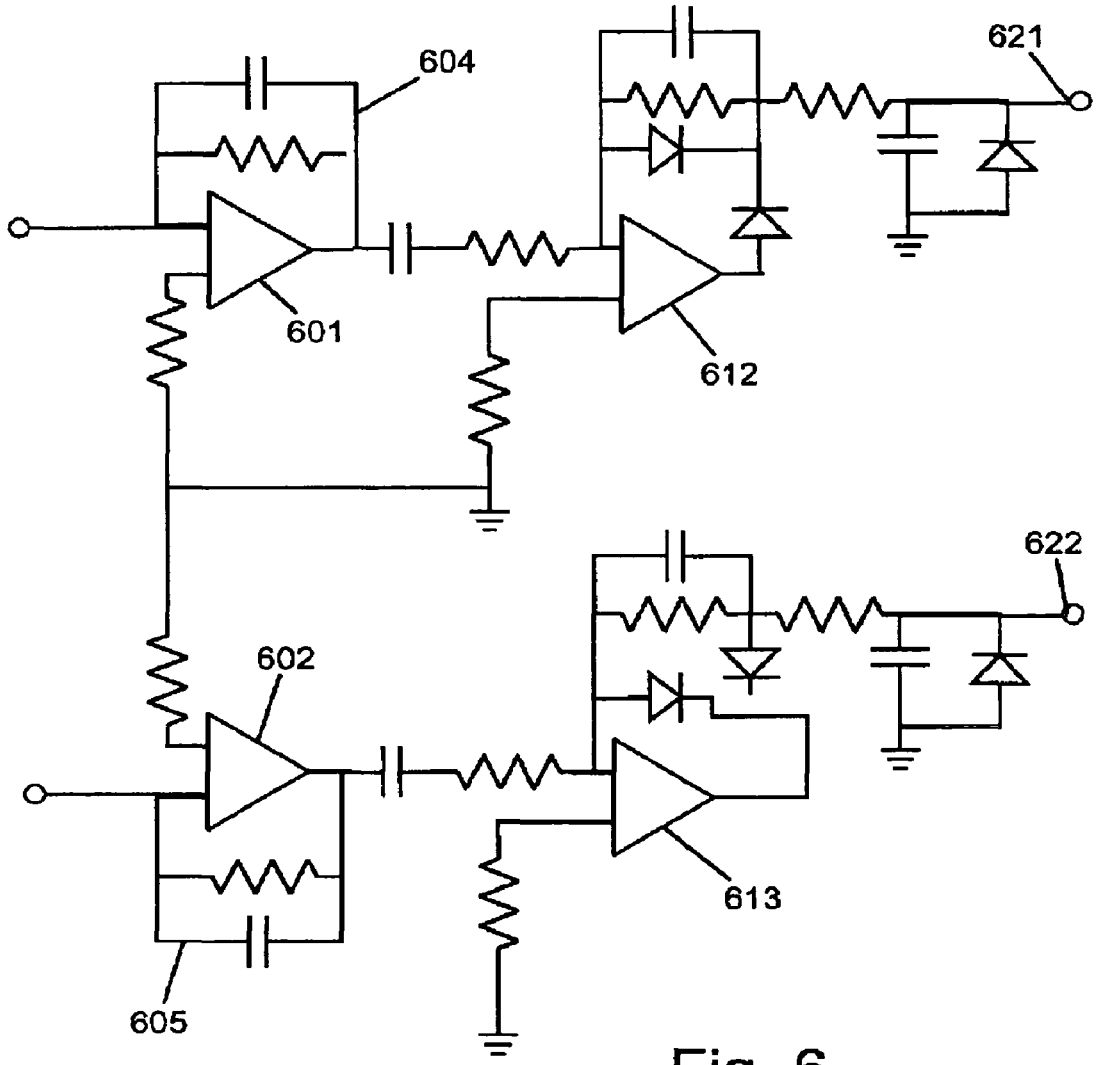
FIG. 6 is a schematic diagram of the receiver signal processing circuit for producing control voltages indicating the touched finger position on sensor.

The details of a preferred analog signal processing circuit for amplifying and shaping the potentials produced at the receiver plates is shown in more detail in FIG. 6. The circuitry provides two identical channels necessary to handle both receivers. Each receiver is connected to the inverting input of one of the operational amplifiers 601 and 602. These inputs are held at virtual ground by the feedback circuits seen at 604 and 605. Current flowing by capacitive coupling from the transmitter plates through each receiver plate is converted to a voltage at the output of each respective operational amplifier 601 and 602. The feedback resistor and capacitor prevent runaway gain at high frequencies which would cause instability. After having been converted to a voltage, the signal is AC coupled to the rectifier/low-pass filter circuits seen at 612 and 613 where the two receiver plate output signals are converted to DC potential outputs at 621 and 622 respectively which are fed to the analog to digital converters and processed by the microprocessor to compute finger position value. The microprocessor also drives a ten-LED array which produces a bargraph display seen at 332 in FIG. 3 which provides a visual indication of the sensed finger position.

This design functions well in the application of finger sensing through glass. One slight problem at the current stage is the tendency of the sensor to track the lateral movements of the hand and arm even when the fingertip remains in the same place. This problem arises because a significant amount of flux incident on the receivers has traveled far from the surface of the glass. We believe a good solution to this problem would be to use narrower transmitters located closer to the receivers (but still isolated by a shield). This would cause the field close to the surface of the glass to be dominant.

CONCLUSION

It is to be understood that the methods and apparatus which have been described above are merely illustrative applications of the principles of the invention. Numerous modifications may be made by those skilled in the art without departing from the true spirit and scope of the invention.

What is claimed is:

1. A touch control comprising, in combination, an elongated control surface, and a shunt mode capacitive sensor adjacent to the elongated control surface for detecting a position of a human finger touching the elongated control surface, wherein the shunt mode capacitive sensor comprises at least one conductive transmitter plate adapted to be driven by an alternating current and to create an electrical field, and first and second receiver plates that are each conductive and adapted to capacitively couple with the at least one conductive transmitter plate, the first receiver plate comprises a first set of tongues, which said first set of tongues comprises more than two tongues, the second receiver plate comprises a second set of tongues, which said second set of tongues comprises more than two other tongues, and the first set of tongues and the second set of tongues are interleaved, the elongated control surface has a first end and a second end, and the width of tongues in the first set of tongues progressively increases, and the width of tongues in the second set of tongues progressively decreases, from the first end to the second end, wherein the at least one conductive transmitter plate comprises a first transmitter plate and a second transmitter plate, and the first receiver plate and the second receiver plate are positioned between the first transmitter plate and the second transmitter plate.

2. The touch control of claim 1, wherein the first set of tongues and the second set of tongues are each comprised of rectangular tongues.

3. The touch control of claim 1, wherein the shunt mode capacitive sensor further comprises a first circuit connected to the first receiver plate for outputting a first signal value indicative of a first sensed value from the first receiver plate, and a second circuit connected to the second receiver plate for outputting a second signal value indicative of a second sensed value from the second receiver plate, and wherein a difference value increases monotonically when the human finger moves from the first end to the second end, with the difference value being equal to the first sensed value minus the second sensed value.

4. The touch control of claim 3, further comprising a microprocessor for generating and storing a position value indicative of where the elongated control surface was touched.

5. The touch control of claim 4, further comprising an array of light emitting diodes controlled by the microprocessor.

6. The touch control of claim 5, wherein the array of light emitting diodes is adapted for providing a visual indication of sensed position of the human finger.

7. The touch control of claim 4, wherein the elongated control surface is part of a cooktop, the touch control is adapted to control energization of at least one cooktop heating element in the cooktop, and the elongated control surface is positioned in a different area of the cooktop than where the at least one cooktop heating element is positioned.

8. The touch control of claim 7, wherein an upper surface of the cooktop comprises ceramic glass, and the shunt mode capacitive sensor is affixed to and positioned beneath the ceramic glass.

9. The touch control of claim 4, wherein tracking begins when a sum falls below a first threshold value, with the sum being equal to the first signal value plus the second signal value.

10. The touch control of claim 9, wherein the microprocessor outputs a first position value, unless the sum of the first signal value and the second signal value is less than the second threshold value, in which case the microprocessor outputs a second position value, with the first position value being indicative of where the elongated control surface was last touched, and the second position value being indicative of where the elongated control surface was last touched before the sum of the first signal value and the second signal value fell below the second threshold value.

11. The touch control of claim 10, wherein the microprocessor is calibrated to output a position value by employing a stored lookup table that is indexed by input values from the first receiver plate and the second receiver plate.

12. The touch control of claim 11, wherein the position value that is outputted is linearly related to an actual touching position.

13. The touch control of claim 12, wherein the first receiver plate and the second receiver plate are isolated from the first transmitter plate and the second transmitter plate by grounded shielding.

14. The touch control of claim 13, wherein the grounded shielding exposes an area where the first set of tongues and the second set of tongues are interleaved but does not expose conductive connections among tongues of the first receiver plate or among tongues of the second receiver plate.

15. A touch control comprising, in combination, an elongated control surface, and a shunt mode capacitive sensor adjacent to the elongated control surface, wherein the shunt mode capacitive sensor comprises at least one conductive transmitter plate for generating an alternating electrical field, and first and second receiver plates that are each conductive and adapted to capacitively couple with the at least one conductive transmitter plate, the first receiver plate comprises a first set of tongues comprised of more than two tongues, the second receiver plate comprises a second set of tongues comprised of more than two other tongues, and the elongated control surface has a first end and a second end, and the first set of tongues and the second set of tongues are interleaved in a pattern that, when a human finger touches the elongated control surface, defines a first area of overlap between the human finger and the first set of tongues and a second area of overlap between the human finger and the second set of tongues, with the first area of overlap being less than the second area of overlap when the human finger touches the first end and the second area of overlap being less than the first area of overlap when the human finger touches the second end, wherein the at least one conductive transmitter plate comprises a first transmitter plate and a second transmitter plate, and the first receiver plate and the second receiver plate are positioned between the first transmitter plate and the second transmitter plate.

16. The touch control of claim 15, wherein the width of tongues in the first set of tongues progressively increases, and the width of tongues in the second set of tongues progressively decreases, from the first end to the second end.

17. The touch control of claim 15, wherein the first area of overlap progressively increases, and the second area of overlap progressively decreases, from the first end to the second end.

18. The touch control of claim 15, wherein the shunt mode capacitive sensor further comprises a first circuit connected to the first receiver plate for outputting a first signal value indicative of a first sensed value from the first receiver plate, and a second circuit connected to the second receiver plate for outputting a second signal value indicative of a second sensed value from the second receiver plate, and wherein a difference value increases monotonically when the human finger moves from the first end to the second end, with the difference value being equal to the first sensed value minus the second sensed value.

19. An elongated shunt mode capacitive sensor comprising:

at least one transmitter plate, first and second receiver plates that are interleaved with each other, are each elongated and are each adapted to capacitively couple with the at least one transmitter plate, a first circuit connected to the first receiver plate for outputting a first signal value indicative of a first sensed value from the first receiver plate, and a second circuit connected to the second receiver plate for outputting a second signal value indicative of a second sensed value from the second receiver plate, wherein the elongated shunt mode capacitive sensor has a first end and a second end, and a difference value varies monotonically when a human finger moves from the first end to the second end, with the difference value being equal to the first sensed value minus the second value, wherein the at least one transmitter plate comprises a first transmitter plate and a second transmitter plate, and the first receiver plate and the second receiver plate are positioned between the first transmitter plate and the second transmitter plate.

20. The elongated shunt mode capacitive sensor of claim 19, wherein the first receiver plate comprises a first set of tongues, the second receiver plate comprises a second set of tongues, the first set of tongues and the second set of tongues are interleaved, the elongated shunt mode capacitive sensor has a first end and a second end, and the width of tongues in the first set of tongues progressively increases, and the width of tongues in the second set of tongues progressively decreases, from the first end to the second end.

* * * * *